US007104880B2

(12) United States Patent
Maki

(10) Patent No.: US 7,104,880 B2
(45) Date of Patent: Sep. 12, 2006

(54) COIN FEEDER

(75) Inventor: Tadanori Maki, Osaka (JP)

(73) Assignee: HIMECS Co., Ltd., Osaka (JP)

( * ) Notice: Subject to any disclaimer, the term of this patent is extended or adjusted under 35 U.S.C. 154(b) by 352 days.

(21) Appl. No.: 10/466,628

(22) PCT Filed: Jan. 19, 2001

(86) PCT No.: PCT/JP01/00365

§ 371 (c)(1),
(2), (4) Date: Jul. 18, 2003

(87) PCT Pub. No.: WO02/058014

PCT Pub. Date: Jul. 25, 2002

(65) Prior Publication Data

US 2004/0048566 A1 Mar. 11, 2004

(51) Int. Cl.
*G07D 1/00* (2006.01)
*A44C 21/00* (2006.01)

(52) U.S. Cl. ..... 453/52; 453/49; 453/50; 453/57

(58) Field of Classification Search ..... 414/680, 414/729, 739, 740, 787; 453/3, 6, 10, 12, 453/18, 29, 39, 49–54, 57, 63; 221/253, 221/254, 203, 217, 277, 279, 226, 163, 167–170, 221/218–220, 172, 173, 222–223, 231, 235, 221/237, 265, 276
See application file for complete search history.

(56) References Cited

U.S. PATENT DOCUMENTS 3,703,903 A 11/1972 Landis et al.
3,904,021 A * 9/1975 Schweitzer ..... 198/360
3,942,541 A * 3/1976 Dupuy ..... 453/56
4,535,794 A * 8/1985 Bellis et al. ..... 453/56
5,976,006 A 11/1999 Snyder
6,080,057 A 6/2000 Bell et al.
6,579,166 B1 * 6/2003 Abe et al. ..... 453/56

FOREIGN PATENT DOCUMENTS

JP 55-141865 10/1980

* cited by examiner

*Primary Examiner*—Gene O. Crawford
*Assistant Examiner*—Jeffrey A. Shapiro
(74) *Attorney, Agent, or Firm*—Watchstone P + D; Stephen B. Parker, Esq.

(57) ABSTRACT

A coin feeder (A) comprises a drum-shaped rotating body capable of feeding not only a single size of coins but also different sizes of coins within an allowable range. A coin receiving part (6) and a coin pressing projection (12) pressing a coin (CN) against the coin receiving part (6) are provided at the inner surface of the peripheral wall (2) of the drum-shaped rotating body (1) capable of rotating vertically with a number of coins (CN)(CN) . . . accommodated therein. A coin pressing projection (12) is operated according to the rotation of the dram-shaped rotating body (1) so as to press-hold the coin (CN) against the inner surface of the peripheral wall (2) and release the pressing of the coin at the upper position. Immediately before the coin press-hold state is released, a coin striking member strikes the coin (CN) and the coin pressing projection (12) urges the coin (CN) so as to eject the coin (CN) toward the side of the drum-shaped rotating body (1), i.e., the front of the coin feeder.

22 Claims, 9 Drawing Sheets

COIN FEEDER

TECHNICAL FIELD

The present invention relates to a coin feeder to be installed in a money exchanger, a ticket vending machine or a game machine such as a slot machine to discharge coins.

BACKGROUND ART

Conventionally, as shown in FIGS. 13 and 14, this kind of coin feeder generally employs the so-called rotor system using a disc-shaped rotating body called a rotor 83 provided with a plurality of coin receiving aperture 84 arranged in the circumferential direction thereof at equal intervals (see, for example, Japanese Examined Laid-open Utility Model Publication No. 4-45084).

In this rotor system coin feeder B, a number of coins randomly accommodated in a hopper 80 provided at the upper portion of the rotor 83 are sequentially fed from the coins CN located at the lowermost portion of the hopper.

That is, in accordance with the rotational movement of the rotor 83, which is equipped below the hopper bottom 81, in the direction of the arrow driven by the electric motor 82, coins CN are fitted in each coin receiving apertures 84. When the coin CN fitted in the coin receiving aperture 84 approaches the coin exit 85, the coin CN gets under the rotor 83 and is moved toward the coin exit 85 while being guided by a guide (not illustrated) to be discharged outside.

Although this rotary system coin feeder B can feed coins each having a diameter slightly smaller than the inner diameter of the coin receiving aperture 84 smoothly at high speed, it was not possible to assuredly feed coins having a diameter other than the above-mentioned diameter or coins having different thickness.

Accordingly, in cases where two types of game machines using coins different in size are manufactured, it is required to manufacture two types of coin feeders each corresponding to each coin size, which is indeed irrational.

The present invention was made in view of the aforementioned technical backgrounds, and the object is to provide a coin feeder capable of feeding not only one size of coins but also different sizes of coins and increasing the allowable range as large as possible.

Other objects of the present invention will be apparent from the following embodiment of the present invention.

DISCLOSURE OF INVENTION

In order to attain the aforementioned objects, in the present invention, in place of the conventional rotor, a drum-shaped rotating body capable of accommodating a number of coins is employed. The drum-shaped rotating body is rotated vertically to pick up a single coin while rotating, and the picked-up coin is released at the upper position of the rotation toward the side direction relative to the rotational direction of the drum-shaped rotating body.

That is to say, the present invention is characterized in that the coin feeder is provided with a drum-shaped rotating body capable of rotating vertically while accommodating a number of coins therein, one or a plurality of coin receiving parts configured to hold a single coin along an inner surface of a peripheral wall of the rotating body, and a releasing means configured to release the coin held by the coin receiving part and raised in accordance with a rotation of the rotating body at a coin raised position toward a side relative to a rotational direction of the drum-shaped rotating body.

With this invention, since the size of coin to be held by the coin receiving part is not limited to a single size, plural types of coins can be handled, which can be expanded versatility capable of being employed in various machines such as a change feeder in which a plurality of coin feeders corresponding to the number of coin types are installed or a game machine using different sizes of coins.

As the simplest structure, the aforementioned coin releasing means can be employed the structure in which the coin receiving part is slightly inclined downwardly toward the front of the drum-shaped rotating body, i.e., the opening face thereof, so that the coin is guided by the inclined coin receiving part when the coin falls by its own weight in accordance with the rotation of the drum-shaped rotating body. In the case of this simple structure, the coin releasing height position is limited. Therefore, it is preferably that a coin pressing means is provided so that the coin is not only held by the coin receiving part but also tied and held so as not to fall by its own weight when the coin is raised in accordance with the rotation of the drum-shaped rotating body.

In cases where the coin pressing means is provided, when the pressing of the coin is released at a predetermined position, the coin falls downward by its own weight. Therefore, a trough-shaped coin receiving member can be provided so as to bridge from the inside of the drum-shaped rotating body to the outside of the drum-shaped rotating body at the releasing position, i.e., the coin falling position. Alternatively, a coin striking member for striking the coin immediately before releasing the pressing of the coin can be equipped above the drum-shaped rotating body to give a jumping force toward the outside of the drum-shaped rotating body the coin by using the urging force of the coin pressing means.

According to the coin feeder equipped with the coin pressing means and the coin striking member as a coin releasing means, since the drum-shaped rotating body can be rotated while holding the coin, the operation rate of the device can be increased.

It is preferable that the coin pressing means is constituted by a moving plate disposed along the external surface of the peripheral wall of the drum-shaped rotating body so as to move in the fore-and-aft direction, a coin pressing projection provided at one end of the moving plate so as to move in an arc-shaped elongated slit formed in the peripheral wall, an urging member to keep the coin pressing projection urging in the coin pressing direction, and a moving plate operating protrusion provided at the other end of the moving plate. In order to function this coin pressing means, it is preferable to provide a cutout portion for allowing the movement of the corresponding end portion of the moving plate at a ring-shaped front panel, a region for holding the coin pressing projection at the coin pressing releasing position by relatively pressing the movable plate operation protrusion, and a region for holding the coin pressing projection at the coin pressing position by releasing the pressing at a surface opposed to an external surface of a ring-shaped front plate. By employing this structure, the pressing of the coin and the releasing of the pressing can be assuredly performed automatically.

Furthermore, it is preferable that the coin pressing releasing position is provided at the upper portion of the drum-shaped rotating body because the coin can be released at the position higher than that the coin pick-up position, i.e., the so-called lifter function can also be performed.

Although the drum-shaped rotating body can be an integral member, it is preferable that the drum-shaped rotating body is formed by a plurality of rotating body peripheral wall constituting members assembled to the ring-shaped front plate and a ring-shaped rear plate provided with gear teeth engaged with a driving gear at the periphery thereof, wherein the ring-shaped front panel is supported by a plurality of grooved rollers, and wherein the drum-shaped rotating body is rotated by engaging the ring-shaped rear plate with the driving gear connected to a driving motor. With this structure, a rotary shaft passing through the inside of the drum-shaped rotating body does not exist and therefore both sides of the drum-shaped rotating body relative to the rotating direction, i.e., the front and rear sides of the coin feeder, can be utilized effectively. Therefore, for example, this enables an easy connection to a coin accommodation tank. Furthermore, in cases where the coin releasing means is a trough-like member which can receive the falling coin, the installation can be performed easily. In addition, the gear structure transmitting the driving force of the driving motor can be simplified, which in turn can downsize the entire device.

Furthermore, it is preferable that the diameter of the peripheral end of the drum-shaped rotating body at the coin releasing side is set to be larger than that of the opposed peripheral end. By employing this structure, in cases where a coin striking member is employed as a coin releasing means, the coin can be released at a relatively high position. Furthermore, since the inner surface of the peripheral wall at the relatively lower position of the drum-shaped rotating body is inclined toward one side, the picking of a single coin can be performed easily, enhancing the operation efficiency of the entire device.

Furthermore, although it is preferable that the rotation axis of the drum-shaped rotating body is horizontal, the axis can be inclined.

BEST MODE FOR CARRYING OUT THE INVENTION

Hereinafter, the present invention will be described based on the attached drawings.

Figure 1:
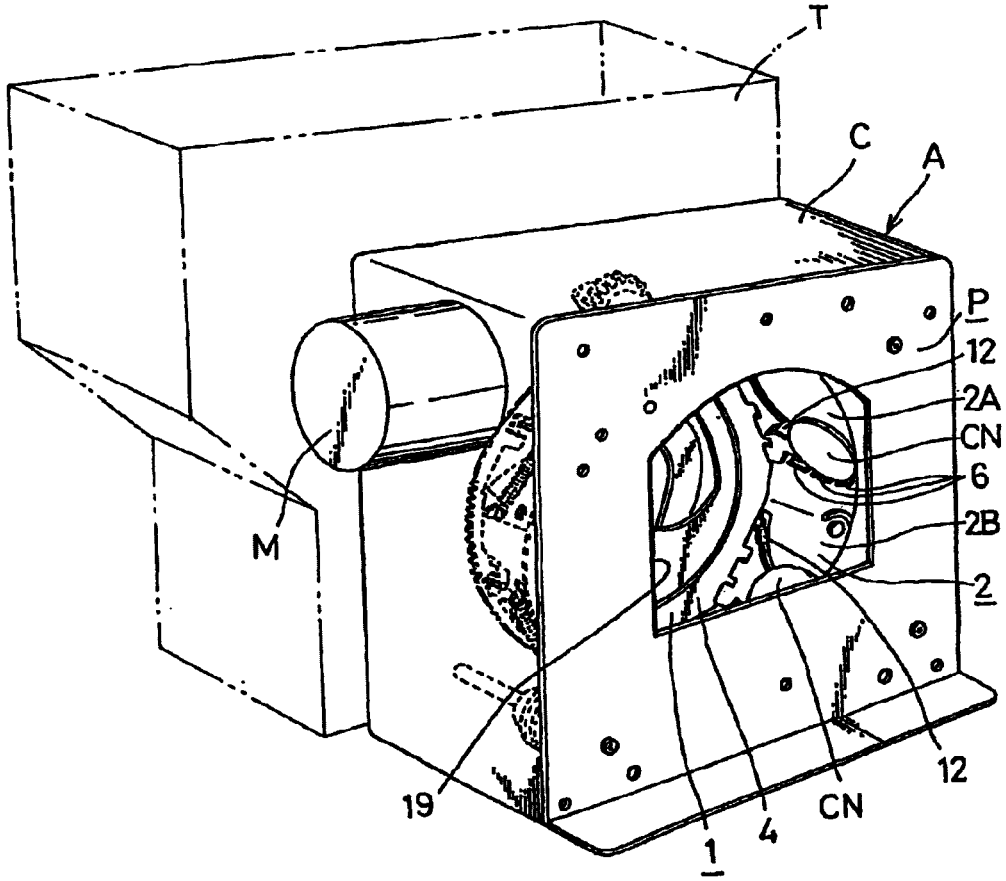
FIG. 1 is a perspective view showing an embodiment of the present invention.

FIG. 1 is a perspective view as seen from the front side, or the coin releasing side of the coin feeder A according to the present invention. The coin feeder A is connected, at its rear side, to a coin accommodation tank T in which a number of coins are accommodated in a randomly accumulated manner.

This coin feeder A is formed by coupling a case C to which a driving motor M is attached to a front panel P to which a drum-shaped rotating body 1 is attached.

Figure 2:
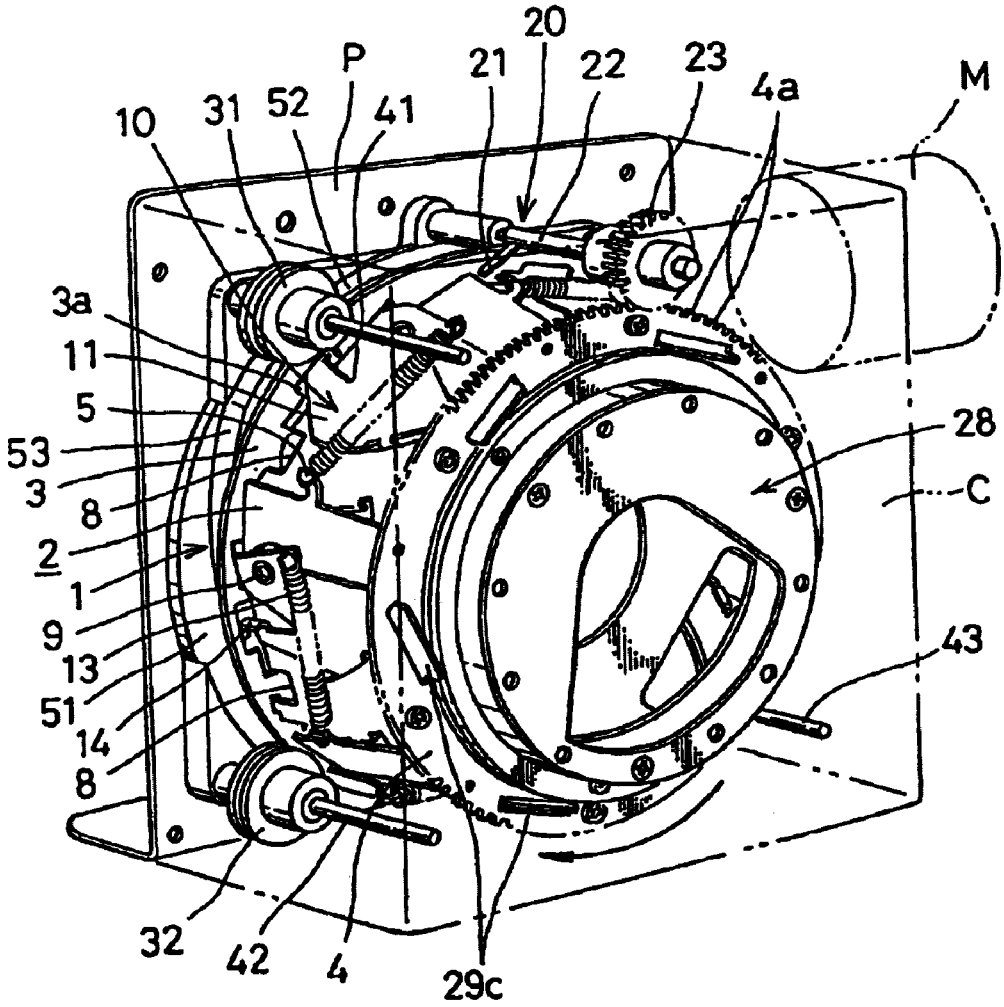
FIG. 2 is the perspective view thereof as seen from the rear side.
Figure 3:
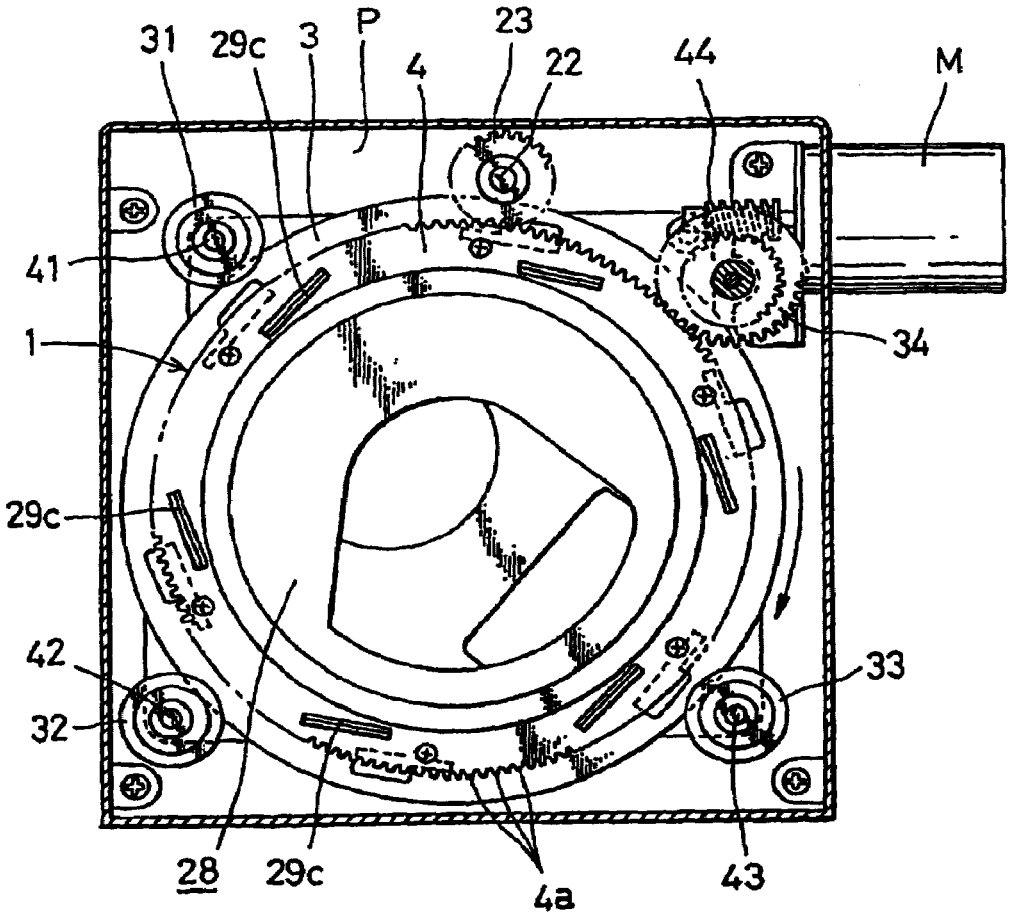
FIG. 3 is the rear view thereof.
Figure 4:
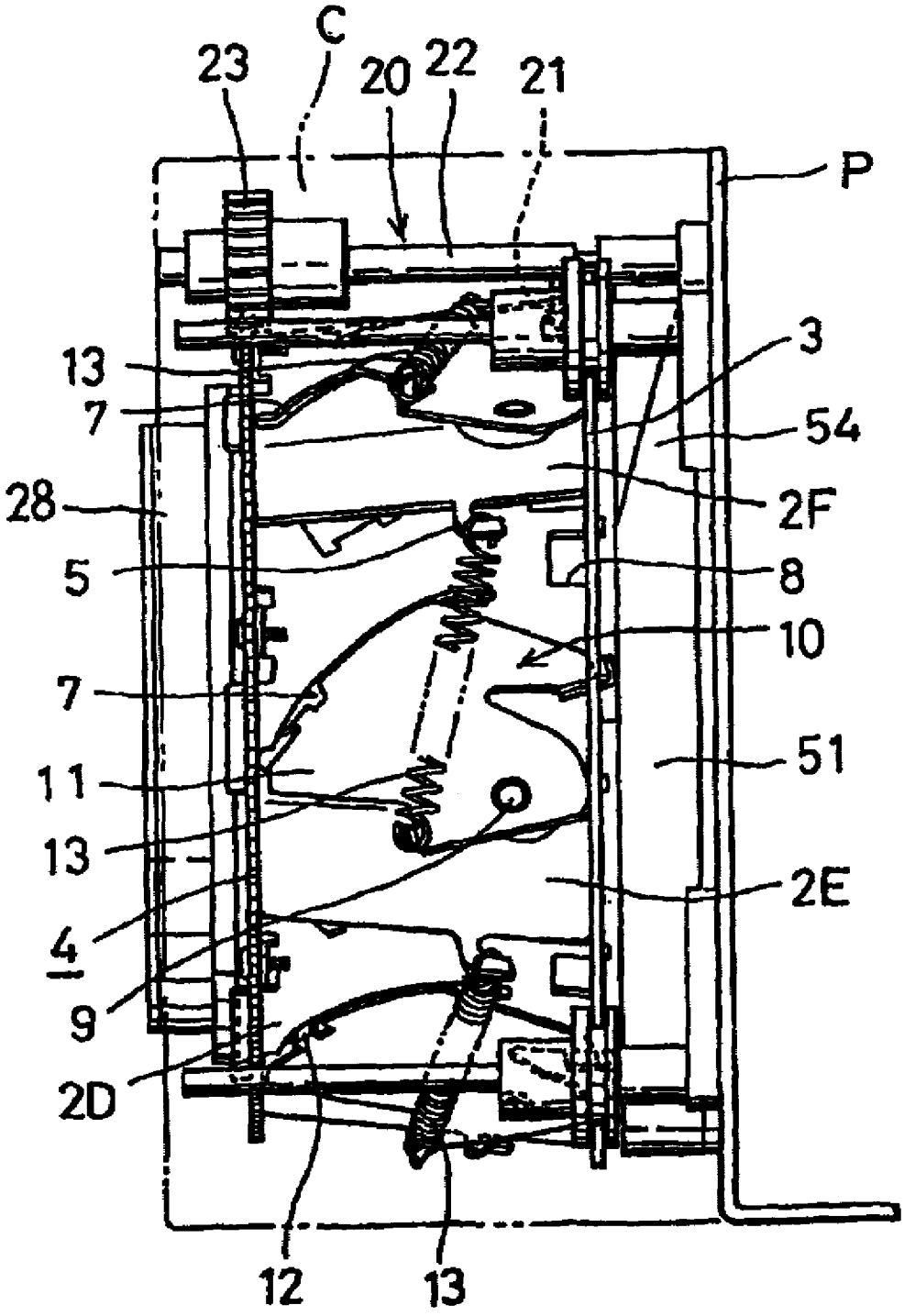
FIG. 4 is the right side view thereof.

FIG. 2 is a perspective view as seen from the rear side showing the state in which the front panel P to which the drum-shaped rotating body 1, etc., is attached is detached together with the drum-shaped rotating body 1 from the case C. FIG. 3 is the rear view thereof, and FIG. 4 is the side view thereof. As shown in these figures, the drum-shaped rotating body 1 is supported by three supporting grooved rollers 31, 32 and 33 at the front side thereof, and is engaged with a gear 34 connected to a driving motor M at the rear side thereof to thereby be rotated vertically. The reference numerals 41, 42 and 43 are a rotating shaft, respectively, with one end thereof supported by the front panel P and the other end supported by the rear panel (not illustrated) of the case C.

At the central portion of the front panel P, a window opening 19 is provided. Through this window opening 19, coins CN are discharged outside the coin feeder A. As illustrated, the lower end of the window opening 19 is located above the front opening lower end of the drum-shaped rotating body 1 so that a certain amount of coins CN can be accommodated in the drum-shaped rotating body 1.

The drum-shaped rotating body 1 is formed by connecting six pieces of rotating body peripheral wall constituting members 2A, 2B, . . . having the same size and shape to the ring-shaped front panel 3 and the ring-shaped rear panel 4 provided, at the peripheral edge, with teeth 4*a*, 4*a* . . . engaged with the gear 34 connected to the driving motor M. This assembling is performed by attaching each peripheral wall constituting member 2A between the ring-shaped front panel 3 and the ring-shaped rear panel 4 with the engaging ledge 29*a*, 29*a* protruded from the side edge portion of the peripheral wall constituting member 2A, . . . corresponding to the ring-shaped front panel 3 and the engaging ledge 29*c* and the screw fastening portion 29*d* protruded from the side edge portion of each peripheral wall constituting member 2A corresponding to the ring-shaped rear panel 4 with the ring-shaped front plate 3 and the ring-shaped rear plate 4 engaged and screwed thereto, respectively. Thus, the drum-shaped rotating body 1 in which the peripheral wall constituting members 2A, 2B, . . . are disposed between the ring-shaped front and rear plates 3 and 4 in the circumferential direction thereof at equal intervals can be obtained.

Attached to the external surface of the ring-shaped rear plate 4 is a coin supply amount adjusting member 28 to be disposed between the rear plate 4 and the coin accommodation tank T. This adjusting member 28 adjusts the number of coins CN to be supplied from the accommodation tank T to the drum-shaped rotating body 1 so that the drum-shaped rotating body 1 can carry out a prescribed function by smoothly rotating.

Each peripheral wall constituting member 2A, 2B, . . . is provided with a coil spring hooking portion 5 extending in the rotating direction of the drum-shaped rotating body 1 at the leading end thereof, a slightly inwardly bent coin receiving part 6 having a height lower than the thickness of the coin CN at the other end thereof, and an arc-shaped elongated slit 7 curving diagonally toward the front side at the central portion thereof. Furthermore, each peripheral wall constituting member 2A . . . is provided with a small aperture 8 for exposing a part of a coin CN outside the peripheral wall at the vicinity of the ring-shaped front panel 3 between the front panel side of the coin receiving arc-shaped elongated slit 7 and that of the coin receiving part 6.

Each peripheral wall constituting member 2A, . . . is provided with a coin holding means 10 for holding a coin CN by pressing the coin CN against the coin receiving part 6 and releasing the pressing of the coin when the coin CN is positioned at the upper position in the drum-shaped rotating body 1.

The coin holding means 10 is constituted by a movable plate 11 disposed along the external surface of the peripheral wall constituting member 2A, . . . so as to pivotally move in the fore-and-aft direction of the drum-shaped rotating body 1, a coin pressing projection 12 provided at one end of the movable plate 11 so as to move in the arc-shaped elongated slit 7 formed in the peripheral wall constituting member 2A, a coil spring 13 as an urging member for urging the coin pressing projection 12 in the coin pressing direction, and a movable plate operating protrusion 14 provided at the other end of the movable plate 11.

The movable plate 11 is disposed along the external surface of the peripheral wall constituting member 2A, . . . so as to swing in the fore-and-aft direction of the drum-shaped rotating body 1 about the supporting axis 9 formed by cutting and outwardly bending a portion of the rotating body peripheral wall constituting member 2A, . . . As shown in FIG. 2, etc., one end of the coil spring 13 is hooked on the movable plate 11 and the other end thereof is hooked on the coil spring hooking claw 5 of the rearward peripheral wall constituting member 2B, . . . .

The ring-shaped front panel 3 is provided with a cutout portion 3*a* for allowing the movement of the end portion of the corresponding movable plate 11. Furthermore, attached to the external surface of the ring-shaped front panel 3 are a pressing region 51 for relatively pressing the movable plate operation protrusion 14 to hold the coin pressing projection 12 at the coin pressing release position and a pressing release region 52 for releasing the pressing of the movable plate operation protrusion 14 to hold the coin pressing projection 12 at the coin pressing position. The aforementioned pressing region 51 is embodied as a lacked circular ring-shaped member. Since the pressing region 51 is a region on which the movable plate operation protrusion 14 slides, the pressing region is formed into a smooth surface to keep a smooth slide of the movable plate operation protrusion 14, and is formed of synthetic resin having small friction coefficient and excellent in wear resistance.

The pressing release region 52 is provided at an upper portion opposed to the external surface of the ring-shaped front panel 3. Formed between the pressing region 51 and the pressing release region 52 are the first cam face 53 descending in the rotational direction and the second cam face 54 ascending in the rotational direction. As the movable plate operation protrusion 14 advances along the pressing region 51, the first cam face 53, the pressing release region 52 and the second cam face 54 in this order and then returns to the pressing region 51, the movement of the coin pressing projection 12 from the coin pressing release position to the coin pressing position and the returning movement thereof from the coin pressing position to the coin pressing release position can be performed automatically.

As shown in FIGS. 2, 9 to 12, above the drum-shaped rotating body 1, a coin releasing means 20 for releasing the coin CN toward the front side of the coin feeder A is provided. This coin releasing means 20 is constituted by a rotary shaft 22 supported between the front and rear panels at the upper side of the drum-shaped rotating body 1, a coin striking member 21 perpendicular to the rotary shaft 22 for striking the coin CN exposed through the small aperture 8 of the peripheral wall constituting member 2A, . . . and a gear 23 provided at one end of the rotary shaft 22 and engaged with the teeth 4*a*, 4*a*, . . . of the ring-shaped rear plate 4. Furthermore, the aforementioned coin pressing projection 12 constitutes a part of this coin releasing means 20. The gear ratio of the gear 23 to the ring-shaped rear plate 4 is set to be 1:6, so that the tip end of the coin striking member 21 comes in and out the small aperture 8 as the small aperture 8 of each peripheral wall constituting member 2A, . . . passes below the coin releasing means 20.

In FIG. 3, the reference numeral 44 denotes a worm gear fixed to the driving shaft of the driving motor M. This worm gear 44 is engaged with an intermediate gear, and the gear 34 coaxially connected to the intermediate gear is engaged with the teeth 4*a*, 4*a*, . . . formed on the peripheral edge of the ring-shaped rear plate 4. As the driving motor M is driven, the gear 34 is rotated clockwise in FIG. 1, and therefore the drum-shaped rotating body 1 is rotated counterclockwise.

Figure 5:
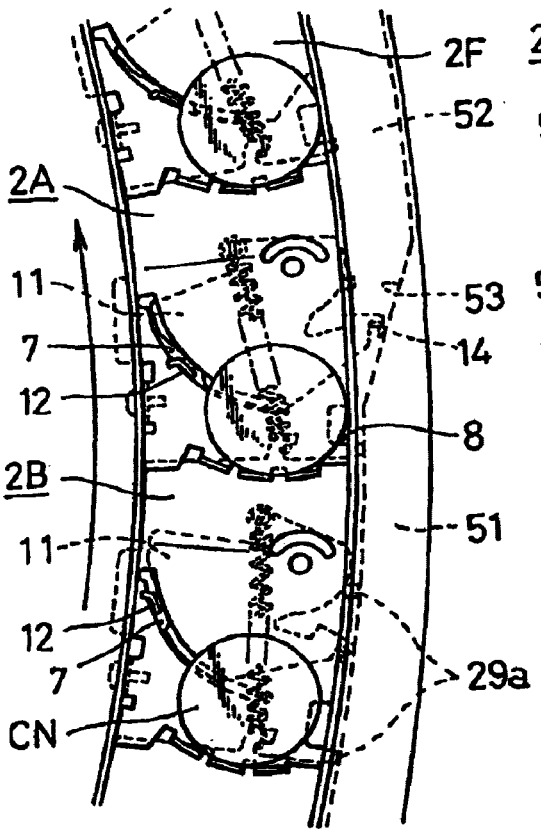
FIG. 5 is an explanatory view as seen from the inside of the drum-shaped rotating body showing the operation status before the coin pressing means presses the coin in the coin feeder according to the embodiment.
Figure 6:
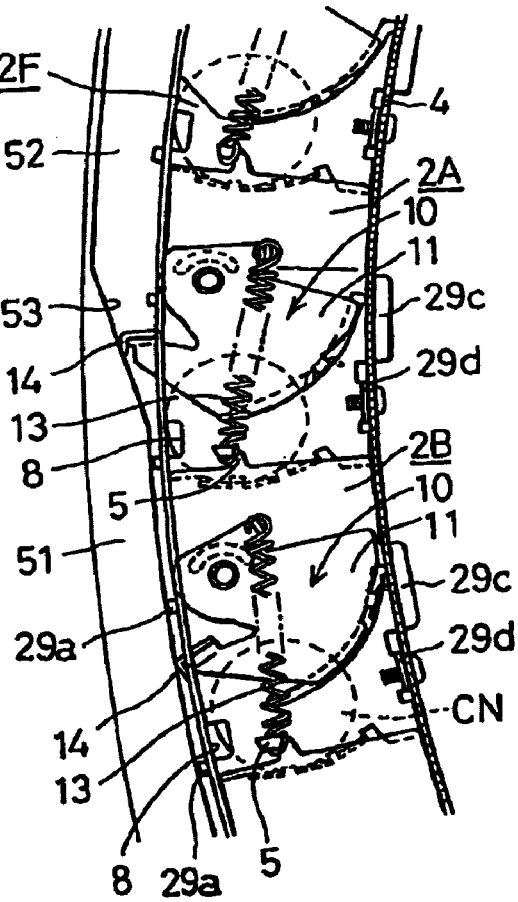
FIG. 6 is an explanatory view as seen from the outside of the drum-shaped rotating body.

Now, the operational status of the coin feeder A will be explained as seen from the inside and the outside of the drum-shaped rotating body 1 as shown in FIGS. 5 to 12. As mentioned above, as the drum-shaped rotating body 1 rotates in accordance with the driving of the driving motor M, a single coin CN among a number of coins CN, CN, . . . accommodated in the lower portion of the drum-shaped rotating body 1 is scooped up and carried upward. FIG. 5 illustrates the state as seen from the inside of the drum-shaped rotating body 1 and FIG. 6 illustrates the state as seen from the outside of the drum-shaped rotating body 1. At this state, the coin pressing projection 12 corresponding to the coin receiving part 6 is located at the coin pressing release position apart from the coin CN since the movable plate operation protrusion 14 positioned at the pressing region 51 opposed to the ring-shaped front panel 3 is pressed.

Figure 7:
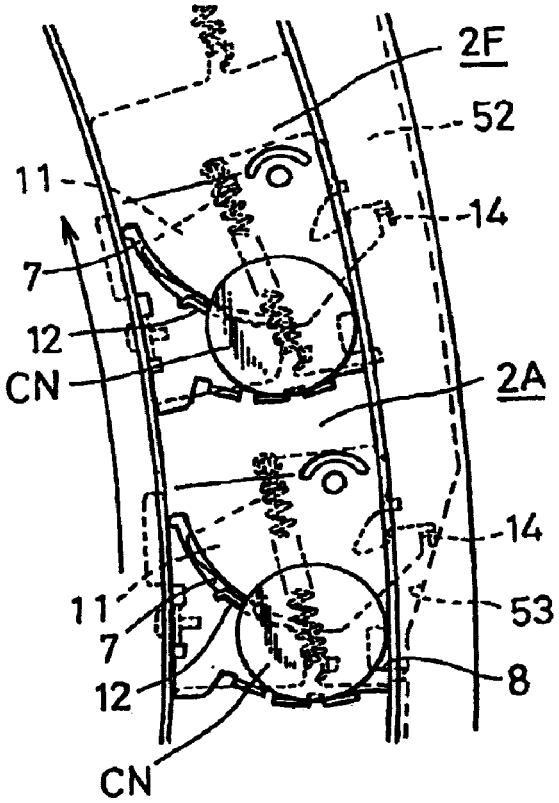
FIG. 7 is an explanatory view as seen from the inside of the drum-shaped rotating body showing the operation status in which the coin pressing means presses the coin in the coin feeder according to the embodiment.
Figure 8:
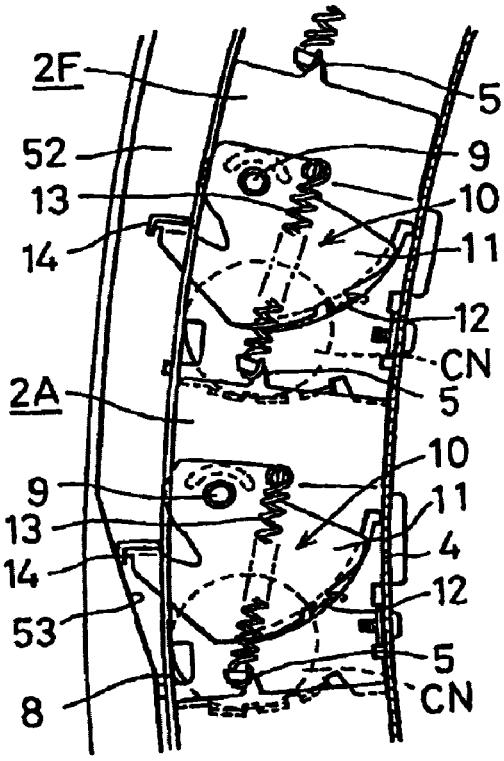
FIG. 8 is an explanatory view as seen from the outside of the drum-shaped rotating body.

When the movable plate operation protrusion 14 attached to the rotational body peripheral wall constituting member 2A begins to pass the first cam face 53 in accordance with the rotation of the drum-shaped rotating body 1, the pressing force against the movable plate operation protrusion 14 weakens progressively, while the movable plate 11 is moved toward the ring-shaped front panel 3 by the urging force of the coil spring 13, whereby the coin pressing projection 12 begins to move along the arc-shaped elongated slit 7 in the direction toward the ring-shaped front panel 3, i.e., in the coin pressing direction. Then, as shown in FIGS. 6 and 7, when the movable plate operation protrusion 14 passes the longitudinal central portion of the first cam face 53, the coin pressing projection 12 which begins to move toward the coin pressing direction comes into contact with the coin CN, and presses and holds the coin CN by the resilient force of the coil spring 13. The subsequent coin receiving parts 6 of the peripheral wall constituting members 2B, 2C, . . . also scoop up coins CN sequentially, and the coin pressing projections 12 are operated to hold the coins CN.

Figure 9:
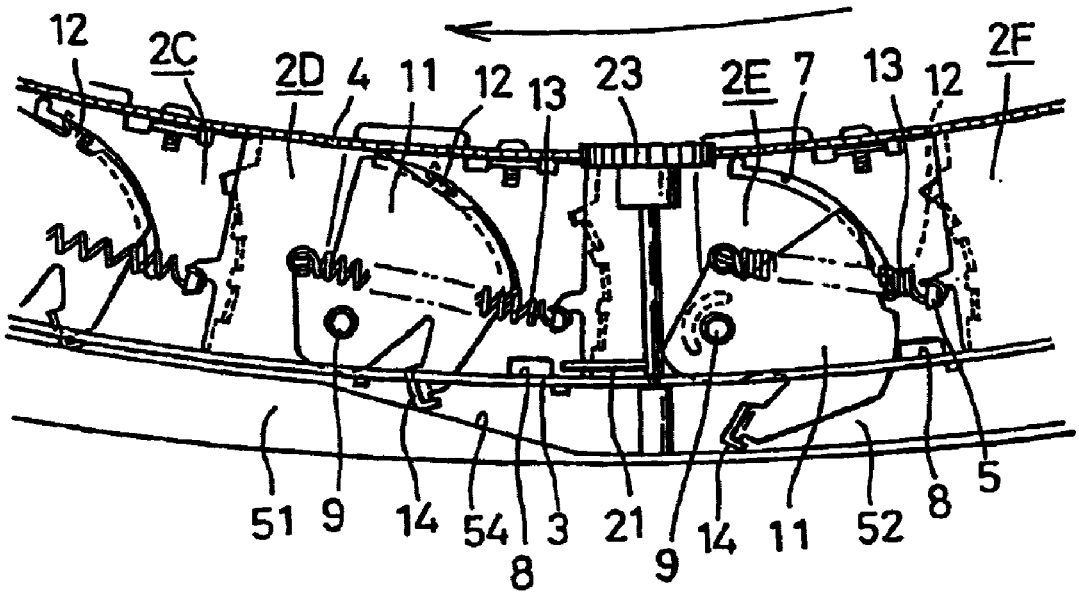
FIG. 9 is en explanatory view showing that the rotating body peripheral wall constituting member not pressing a coin passes above the coin feeder in the coin feeder according to the embodiment.

FIG. 9 is an explanatory view showing the state when the rotating body peripheral wall constituting member 2E not holding a coin CN passes above the coin feeder A, or when the movable plate operation protrusion 14 of the rotating body peripheral wall constituting member 2E passes the pressing release region 52. In this state, since a coin CN does not exist, the coin pressing projection 12 is moved along the arc-shaped elongated slit 7 to the position near the ring-shaped front panel 3. Furthermore, in the rotating body peripheral wall constituting member 2D ahead of the aforementioned rotating body peripheral wall constituting member 2E, the movable plate operation protrusion 14 is moved in the direction toward the ring-shaped rear plate 4 by being pressed by the second cam face 54, and the coin pressing projection 12 is positioned at the coin pressing release position.

Figure 10:
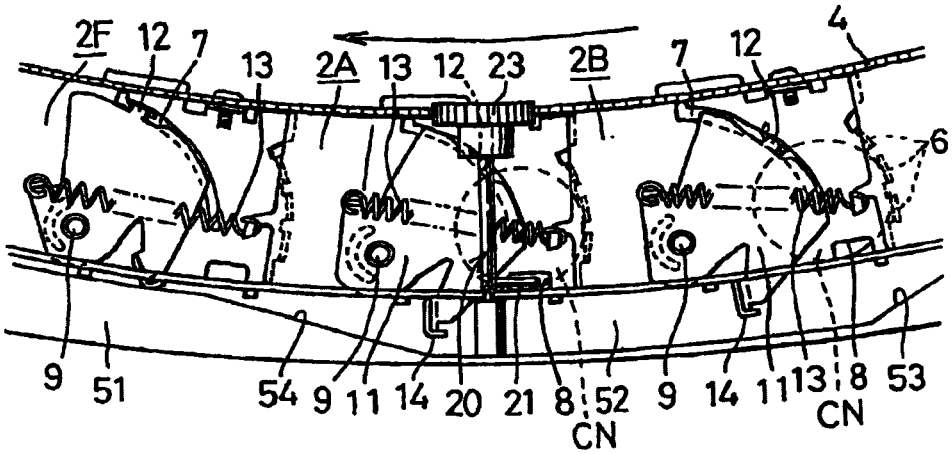
FIG. 10 is an explanatory view as seen from the outside of the drum-shaped rotating body before the coin releasing (relating the coin pressing and striking the coin) in the coin feeder according to the embodiment.
Figure 11:
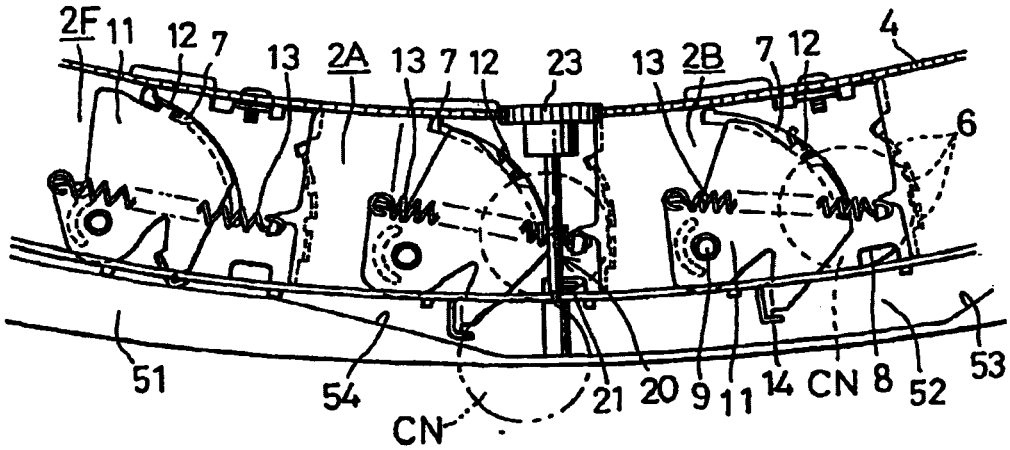
FIG. 11 is an explanatory view as seen from the outside of the drum-shaped rotating body at the time of the coin releasing (striking the coin and releasing the coin pressing) in the coin feeder according to the embodiment.
Figure 12:
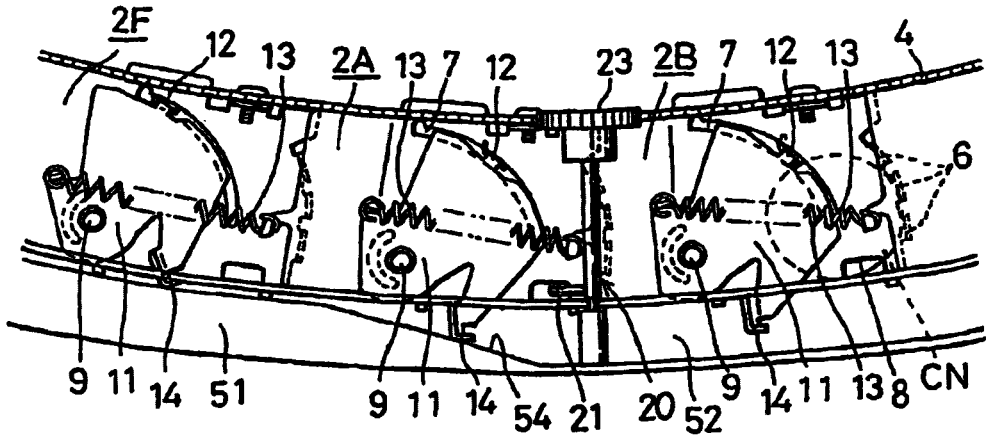
FIG. 12 is an explanatory view as seen from the outside of the drum-shaped rotating body after the coin releasing (relating the coin pressing and striking the coin) in the coin feeder according to the embodiment.
Figure 13:
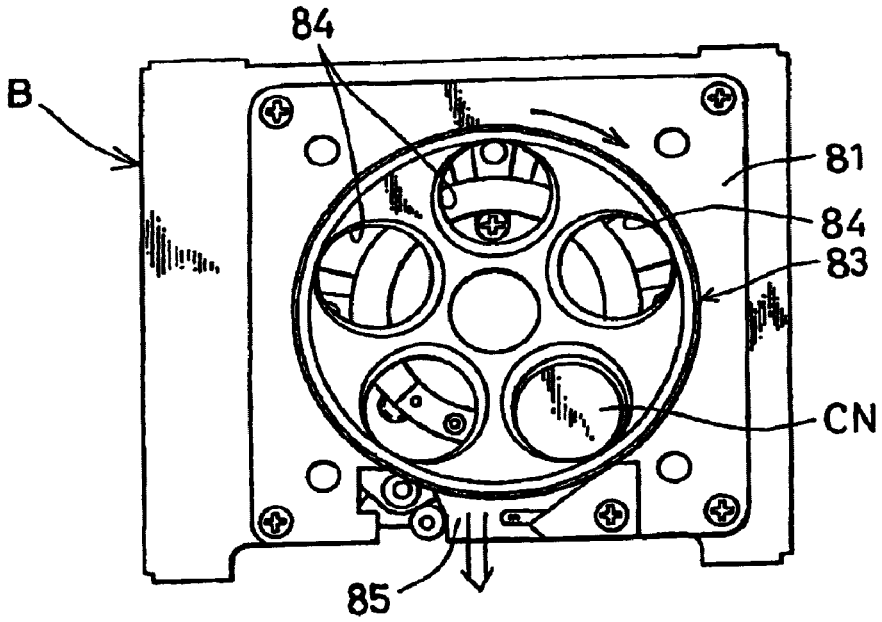
FIG. 13 is a side view showing a conventional rotor system coin feeder.
Figure 14:
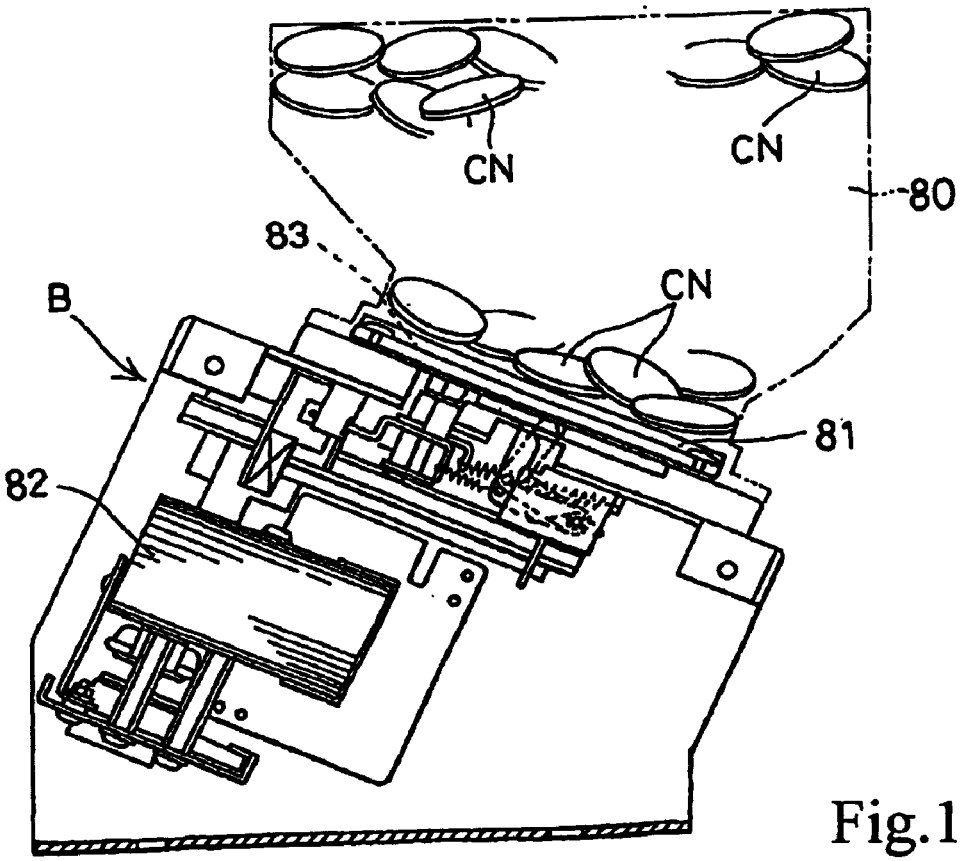
FIG. 14 is a plane view showing the principal portion thereof.

FIGS. 10 to 12 are views showing from the state where the rotating body peripheral wall constituting member 2A to which a coin CN is held in a pressed manner passes below the rotary shaft 22 of the coin striking member 21 to the state where the rotating body peripheral wall constituting member 2A has passed below the rotary shaft 22. When the rotating body peripheral wall constituting member 2A begins to pass below the rotary shaft 22 of the coin striking member 21, the coin striking member 21 rotates to be positioned above the small aperture 8 through which the coin CN is exposed as shown in FIG. 10. In this state, the movable plate operation protrusion 14 of the rotating body peripheral wall constituting member 2A is still located within the pressing release region 52, which is immediately before coming into contact with the second cum face 54.

At the same time when the drum-shaped rotating body 1 rotates a little more and the movable plate operation protrusion 14 begins to pass the second cam face 54 as shown in FIG. 11, the coin striking member 21 rotates downward to enter the small aperture 8 to thereby strike the coin CN strongly. FIG. 11 shows a status immediately before the above-mentioned status.

When the drum-shaped rotating member 1 rotates a little more from the above state, the coin striking member 21 reversely rotating in accordance with the rotation of the drum-shaped rotor 1 comes into the small aperture 8 to strongly hit the coin CN, which makes the coin CN pressed and held by the coin pressing protrusion 12 release from the press-held state to drop downwardly. At this state, since the urging force toward the coin pressing direction by the coin pressing projection 12 is still in operative, the urging force functions to the coin which is immediately before the drop as a jumping force toward the side of the drum-shaped rotating body 1. The jumping out coin CN is shown in FIG. 11 with a dot-dashed line.

Immediately thereafter, when the movable plate operation protrusion 14 comes into contact with the second cam face 54 to be pressed, the movable plate 11 is moved toward the ring-shaped rear plate 4, which in turn makes the coin pressing projection 12 move to the coin pressing release position.

FIG. 12 shows the rotating body peripheral wall constituting member 2A and the coin releasing means 20 after releasing the coin CN. In this state, the movable plate operation protrusion 14 of the rotating body peripheral wall constituting member 2A has arrived at the longitudinal central portion of the second cam face 54, the movable plate 11 begins to move toward the ring-shaped rear plate 4 and the coin pressing projection 12 begins to move toward the ring-shaped rear plate 4. At this state, the coin striking member 21 after striking the coin CN comes from the small aperture 8 and begins to rotate upwardly.

From this state, when the drum-shaped rotating body 1 rotates further, as shown by the preceding rotating body peripheral wall constituting member 2F shown in this figure, the movable plate operation protrusion 14 came into the pressing region 51 after passing the second cam face 54 is pressed. Thus, the movable plate 11 is moved toward the ring-shaped rear plate 4, and the coin pressing projection 12 moves near the ring-shaped rear plate 4. This state will be held until the movable plate operation protrusion 14 reaches the preceding first cam face 53.

Thus, the coin pressing projections 12 of the following rotating member peripheral wall constituting members 2B, 2C, . . . are brought into operation in the similar manner as in the coin pressing projections 12 of the aforementioned rotating member peripheral wall constituting member 2A. In accordance with the operation, since the coin releasing means comes into action, whereby coins CN, CN, . . . are discharged from the coin feeder A one after another.

INDUSTRIAL APPLICABILITY

As mentioned above, in the coin feeder according to the present invention, since the size of the coin to be held by the coin receiving part is not limited to one size, the coin feeder can cope with plural different sizes of coins. Therefore, it can be employed various types of machines such as a change feeder in which a plurality of coin feeders depending on the number of coin types are built or game machines using different sizes of coins.

The invention claimed is:

1. A coin feeder, comprising:

a drum-shaped rotating body (1) capable of rotating vertically while accommodating a number of coins (CN) (CN);

one or a plurality of coin receiving parts (6) to hold a single coin (CN) along an inner surface of a peripheral wall (2) of the rotating body (1); and a releasing means (20) configured to release the coin (CN) held by the coin receiving part (6) and raised in accordance with a rotation of the drum-shaped rotating body (1) at a coin raised position toward a side relative to a rotational direction of the drum-shaped rotating body (1), wherein the drum-shaped rotating body (1) is provided, at the peripheral wall (2), with a coin pressing means (10) configured to hold the coin (CN) in the coin receiving part (6) by pressing and release the pressing when the coin (CN) is positioned at an upper portion in the drum-shaped rotating body (1).

2. The coin feeder as recited in claim 1, wherein the releasing means (20) is configured to operate at the time of releasing the pressing of the coin.

3. The coin feeder as recited in claim 1, wherein the drum-shaped rotating body (1) is formed by attaching the peripheral wall (2) to the ring-shaped front panel (3) and the ring-shaped rear panel (4) having teeth (4*a*) (4*a*) engaged with a driving gear (34) at a peripheral edge thereof, wherein the ring-shaped front panel (3) is supported by a plurality of grooved rollers (31) (32) (33), and wherein the ring-shaped rear plate (4) is engaged with the driving gear (34) connected to a driving motor (M) to thereby rotate the drum-shaped rotating body (1).

4. The coin feeder as recited in claim 3, wherein the peripheral wall (2) of the drum-shaped rotating body (1) is constituted by a plurality of rotating body peripheral wall constituting members (2A) (2B).

5. The coin feeder as recited in claim 2, wherein the coin pressing means (10) includes:

a moving plate (11) disposed along the external surface of the peripheral wall (2) of the drum-shaped rotating body (1) 50 as to move in the fore-and-aft direction of the drum-shaped rotating body (1);

a coin pressing projection (12) provided at one end of the moving plate (11) so as to move in an arc-shaped elongate slit (7) formed in the peripheral wall (2);

an urging member (13) which functions so as to keep the coin pressing projection (12) urging in the coin pressing direction; and a moving plate operating protrusion (14) provided at the other end of the moving plate (11), wherein a cutout portion 3*a* for allowing the movement of the corresponding end portion of the moving plate 11 is formed in the ring-shaped front panel 3, wherein, at a surface opposed to the ring-shaped front plate (3), a region for holding the coin pressing projection (12) at the coin pressing release position by relatively pressing the movable plate operation protrusion (14) and a region for holding the coin pressing projection (12) at the coin pressing position by releasing the pressing are provided, and wherein the coin pressing release position is provided at an upper portion in the drum-shaped rotating member (1).

6. The coin feeder as recited in claim 5, wherein the coin pressing means (10) is provided at each rotating body peripheral wall constituting member (2A) (2B).

7. The coin feeder as recited in claim 5, wherein the coin releasing means (20) is constituted by a coin striking member (21) provided above the drum-shaped rotating body (1) and a coin pressing projection (12) for giving a force to jump the coin (CN) outside of the drum-shaped rotating body (1) at the time of striking the coin by the coin striking member (21).

8. The coin feeder as recited in claim 1, wherein the drum-shaped rotating body (1) is set to have a diameter of a peripheral end thereof at the coin releasing side larger than that of an opposed peripheral end thereof.

9. The coin feeder as recited in claim 2, wherein the drum-shaped rotating body (1) is formed by attaching the peripheral wall (2) to the ring-shaped front panel (3) and the ring-shaped rear panel (4) having teeth (4*a*) (4*a*) engaged with a driving gear (34) at a peripheral edge thereof, wherein the ring-shaped front panel (3) is supported by a plurality of grooved rollers (31) (32) (33), and wherein the ring-shaped rear plate (4) is engaged with the driving gear (34) connected to a driving motor (M) to thereby rotate the drum-shaped rotating body (1).

10. The coin feeder as recited in claim 3, wherein the coin pressing means (10) includes:

a moving plate (11) disposed along the external surface of the peripheral wall (2) of the drum-shaped rotating body (1) SO as to move in the fore-and-aft direction of the drum-shaped rotating body (1);

a coin pressing projection (12) provided at one end of the moving plate (11) so as to move in an arc-shaped elongate slit (7) formed in the peripheral wall (2);

an urging member (13) which functions so as to keep the coin pressing projection (12) urging in the coin pressing direction; and a moving plate operating protrusion (14) provided at the other end of the moving plate (11), wherein a cutout portion 3*a* for allowing the movement of the corresponding end portion of the moving plate 11 is formed in the ring-shaped front panel 3, wherein, at a surface opposed to the ring-shaped front plate (3), a region for holding the coin pressing projection (12) at the coin pressing release position by relatively pressing the movable plate operation protrusion (14) and a region for holding the coin pressing projection (12) at the coin pressing position by releasing the pressing are provided, and wherein the coin pressing release position is provided at an upper portion in the drum-shaped rotating member (1).

11. The coin feeder as recited in claim 4, wherein the coin pressing means (10) includes:

a moving plate (11) disposed along the external surface of the peripheral wall (2) of the drum-shaped rotating body (1) so as to move in the fore-and-aft direction of the drum-shaped rotating body (1);

a coin pressing projection (12) provided at one end of the moving plate (11) so as to move in an arc-shaped elongate slit (7) formed in the peripheral wall (2);

an urging member (13) which functions so as to keep the coin pressing projection (12) urging in the coin pressing direction; and a moving plate operating protrusion (14) provided at the other end of the moving plate (11), wherein a cutout portion 3*a* for allowing the movement of the corresponding end portion of the moving plate 11 is formed in the ring-shaped front panel 3, wherein, at a surface opposed to the ring-shaped front plate (3), a region for holding the coin pressing projection (12) at the coin pressing release position by relatively pressing the movable plate operation protrusion (14) and a region for holding the coin pressing projection (12) at the coin pressing position by releasing the pressing are provided, and wherein the coin pressing release position is provided at an upper portion in the drum-shaped rotating member (1).

12. The coin feeder as recited in claim 6, wherein the coin releasing means (20) is constituted by a coin striking member (21) provided above the drum-shaped rotating body (1) and a coin pressing projection (12) for giving a force to jump the coin (CN) outside of the drum-shaped rotating body (1) at the time of striking the coin by the coin striking member (21).

13. The coin feeder as recited in claim 2, wherein the drum-shaped rotating body (1) is set to have a diameter of a peripheral end thereof at the coin releasing side larger than that of an opposed peripheral end thereof.

14. The coin feeder as recited in claim 3, wherein the drum-shaped rotating body (1) is set to have a diameter of a peripheral end thereof at the coin releasing side larger than that of an opposed peripheral end thereof.

15. The coin feeder as recited in claim 4, wherein the drum-shaped rotating body (1) is set to have a diameter of a peripheral end thereof at the coin releasing side larger than that of an opposed peripheral end thereof.

16. The coin feeder as recited in claim 5, wherein the drum-shaped rotating body (1) is set to have a diameter of a peripheral end thereof at the coin releasing side larger than that of an opposed peripheral end thereof.

17. The coin feeder as recited in claim 6, wherein the drum-shaped rotating body (1) is set to have a diameter of a peripheral end thereof at the coin releasing side larger than that of an opposed peripheral end thereof.

18. The coin feeder as recited in claim 7, wherein the drum-shaped rotating body (1) is set to have a diameter of a peripheral end thereof at the coin releasing side larger than that of an opposed peripheral end thereof.

19. The coin feeder as recited in claim 9, wherein the drum-shaped rotating body (1) is set to have a diameter of a peripheral end thereof at the coin releasing side larger than that of an opposed peripheral end thereof.

20. The coin feeder as recited in claim 10, wherein the drum-shaped rotating body (1) is set to have a diameter of a peripheral end thereof at the coin releasing side larger than that of an opposed peripheral end thereof.

21. The coin feeder as recited in claim 11, wherein the drum-shaped rotating body (1) is set to have a diameter of a peripheral end thereof at the coin releasing side larger than that of an opposed peripheral end thereof.

22. The coin feeder as recited in claim 12, wherein the drum-shaped rotating body (1) is set to have a diameter of a peripheral end thereof at the coin releasing side larger than that of an opposed peripheral end thereof.

* * * * *